US005746040A

United States Patent [19]

Young et al.

[11] Patent Number: 5,746,040

[45] Date of Patent: May 5, 1998

[54] MODULAR WALL CONSTRUCTION

[75] Inventors: Ronald A. Young; Gregory C. Young, both of Denver, N.C.

[73] Assignee: Wireway/Husky Corp., Denver, N.C.

[21] Appl. No.: 700,033

[22] Filed: Aug. 20, 1996

[51] Int. Cl.[6] ..... E04B 1/00

[52] U.S. Cl. ..... 52/775; 52/762; 52/770; 52/781; 52/489.1; 52/357; 52/285.3

[58] Field of Search ..... 52/775, 762, 770, 52/781, 483.1, 489.1, 284–285.3, 664, 243, 348, 351, 353, 357–360; 256/24, 32, 47

[56] References Cited

U.S. PATENT DOCUMENTS

| | | |
|---|---|---|
| 2,529,648 | 11/1950 | Borton . |
| 3,228,157 | 1/1966 | Jacobson . |
| 3,734,467 | 5/1973 | Weeden . |
| 3,839,834 | 10/1974 | Goddard . |
| 4,063,714 | 12/1977 | Kirkwood . |
| 4,083,535 | 4/1978 | Britt . |
| 4,188,019 | 2/1980 | Meredith . |
| 4,197,952 | 4/1980 | De Fouw et al. . |
| 4,255,120 | 9/1980 | McLaughlin . |
| 4,428,172 | 1/1984 | Larsson . |
| 4,623,128 | 11/1986 | Dutch et al. . |
| 4,704,835 | 11/1987 | Jordan . |
| 4,794,744 | 1/1989 | Young et al. . |
| 5,430,984 | 7/1995 | Young et al. . |

*Primary Examiner*—Robert Canfield

[57] ABSTRACT

A modular wall construction includes a plurality of laterally spaced support posts having mutually spaced slots in commonly facing walls thereof, each slot being at least partially defined by oppositely disposed first and second edge segments. At least one panel is arranged between the support posts. In one embodiment, connecting elements are integrally formed with and extend laterally from the panel to overlie the commonly facing walls of the support posts at the slots. In an alternative embodiment, connecting elements are removably coupled to extend laterally from the panel to overlie the commonly facing walls of the support posts at the slots. The connecting elements have hook shaped portions received in the slots in engagement with the first edge segments thereof. A fastener extends into the slots between the connecting element and the second edge segments to coact in engagement with the slot and connecting element to prevent disengagement of the hook portions from the first edge segments.

19 Claims, 5 Drawing Sheets

FIG. 3
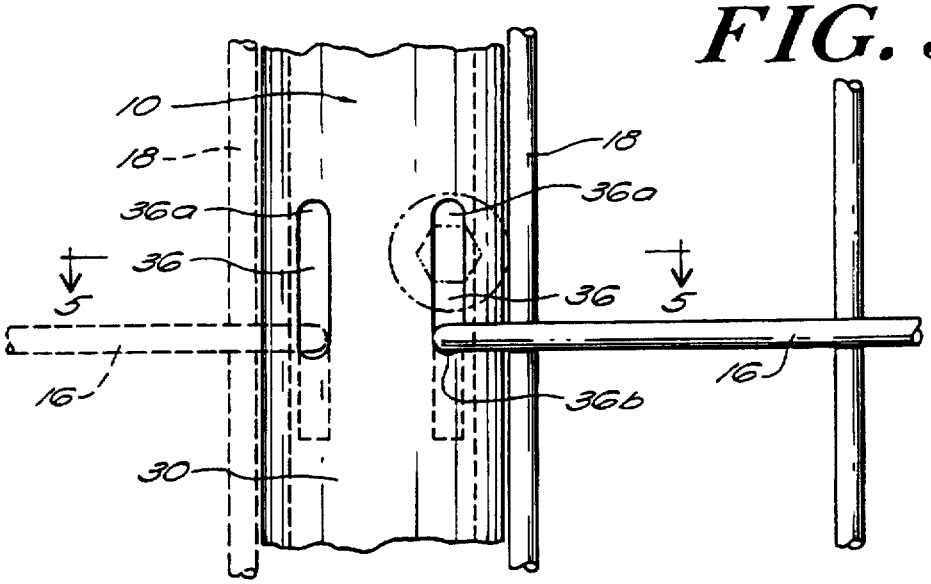
FIG. 4
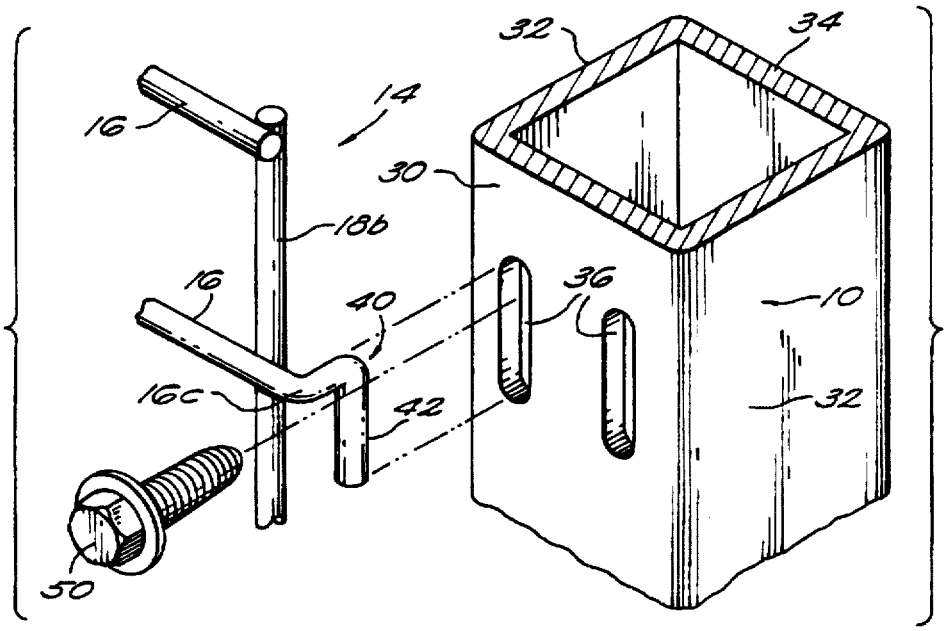
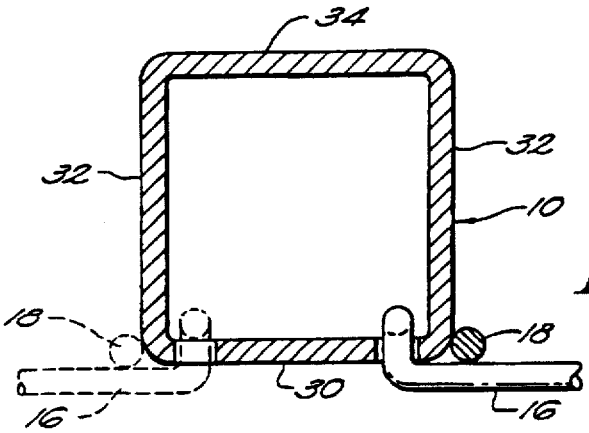
FIG. 5

MODULAR WALL CONSTRUCTION

BACKGROUND OF THE INVENTION

The invention relates to a wall construction for modular panels of interconnected rods.

Conventional modular wall constructions use modular woven wire partitions that are made up of individual rectangular panels arranged vertically one above the other as well as side by side in a horizontally adjacent relationship. During erection, the horizontally adjacent panels are bolted together. This is an extremely time consuming operation which adds significantly to the overall cost of an installation.

A particularly convenient modular wall construction is described in U.S. Pat. No. 4,794,744 entitled "Wall Construction for Modular Woven Wire Partition", and incorporated herein by reference. A wall construction is described for a modular woven wire partition including a plurality of panels arranged vertically in a coplanar relationship between a plurality of laterally spaced vertically disposed fixed support posts. Each of the support posts includes a plurality of vertically spaced openings for receiving tab connector elements associated with the panels. The connector elements are engageable with the openings to thereby connect the panels to the support posts. Each successive connected panel prevents a lower panel from being removed from the support post. The top most vertically disposed panel includes a keeper plate or extensions associated with the support posts for preventing lifting and removal of the uppermost panels, thus safeguarding the wall structure against unauthorized disassembly.

Another convenient modular wall construction is described in U.S. Pat. No. 5,430,984 entitled "Modular Wall Construction Utilizing Woven Wire Partitions", and incorporated herein by reference. A modular wall construction utilizing woven wire partitions is described as including a plurality of laterally spaced support posts with at least one panel provided to be arranged between the support posts. One or both of the post and frame of the panel include aligned mutually spaced slots in commonly facing walls thereof, each slot being at least partially defined by oppositely disposed first and second edge segments. Connecting elements are secured to and extend laterally from the either the panel or post to overly the walls of the adjacent post or panel and the respective slots. The connecting elements include hook shaped portions which are received in the slots in engagement with the first edge segments, and have openings therein aligned with the slots adjacent to the second edge segments thereof. Fasteners extend through the openings into the slots to coact in engagement with the second edge segments to prevent disengagement of the hook portions from the first edge segments.

While the aforementioned wall constructions are particularly useful and easy to use, the industry demands easier and cheaper wall constructions. Unfortunately, the conventional constructions are driven by the use of panels which are essentially framed woven wire partitions. One element of the conventional constructions which can be modified to be less expensive and less mechanically complicated is the panels themselves. It would be desirable to avoid the cost and time of assembling the framed woven wire partitions and the subsequent attachment of separate connecting elements.

Accordingly, it is an object of the present invention to provide a modular construction in which each of the panels may be rapidly secured between support posts in a simple straight forward manner.

It is a further object of the present invention to provide a modular construction which is less expensive and mechanically simplified to use.

SUMMARY OF THE INVENTION

A modular wall construction includes a plurality of laterally spaced support posts having mutually spaced slots in commonly facing walls thereof, each slot being at least partially defined by oppositely disposed first and second edge segments. At least one panel is arranged between the support posts. In one embodiment, connecting elements are integrally formed with and extend laterally from the panel to overlie the commonly facing walls of the support posts at the slots. In an alternative embodiment, connecting elements are removably coupled to extend laterally from the panel to overlie the commonly facing walls of the support posts at the slots. The connecting elements have hook shaped portions received in the slots in engagement with the first edge segments thereof. A fastener extends into the slots between the connecting element and the second edge segments to coact in engagement with the slot and connecting element to prevent disengagement of the hook portions from the first edge segments.

BRIEF DESCRIPTION OF THE DRAWINGS

FIG. 3 is an enlarged view of the circled area designated "A" in FIG. 1;

FIG. 4 is an enlarged perspective view of a connector element of the present invention and a support post prior to assembly;

FIG. 5 is a horizontal sectional view taken along line 5—5 of FIG. 3;

DETAILED DESCRIPTION OF THE ILLUSTRATED EMBODIMENTS

Figure 1:
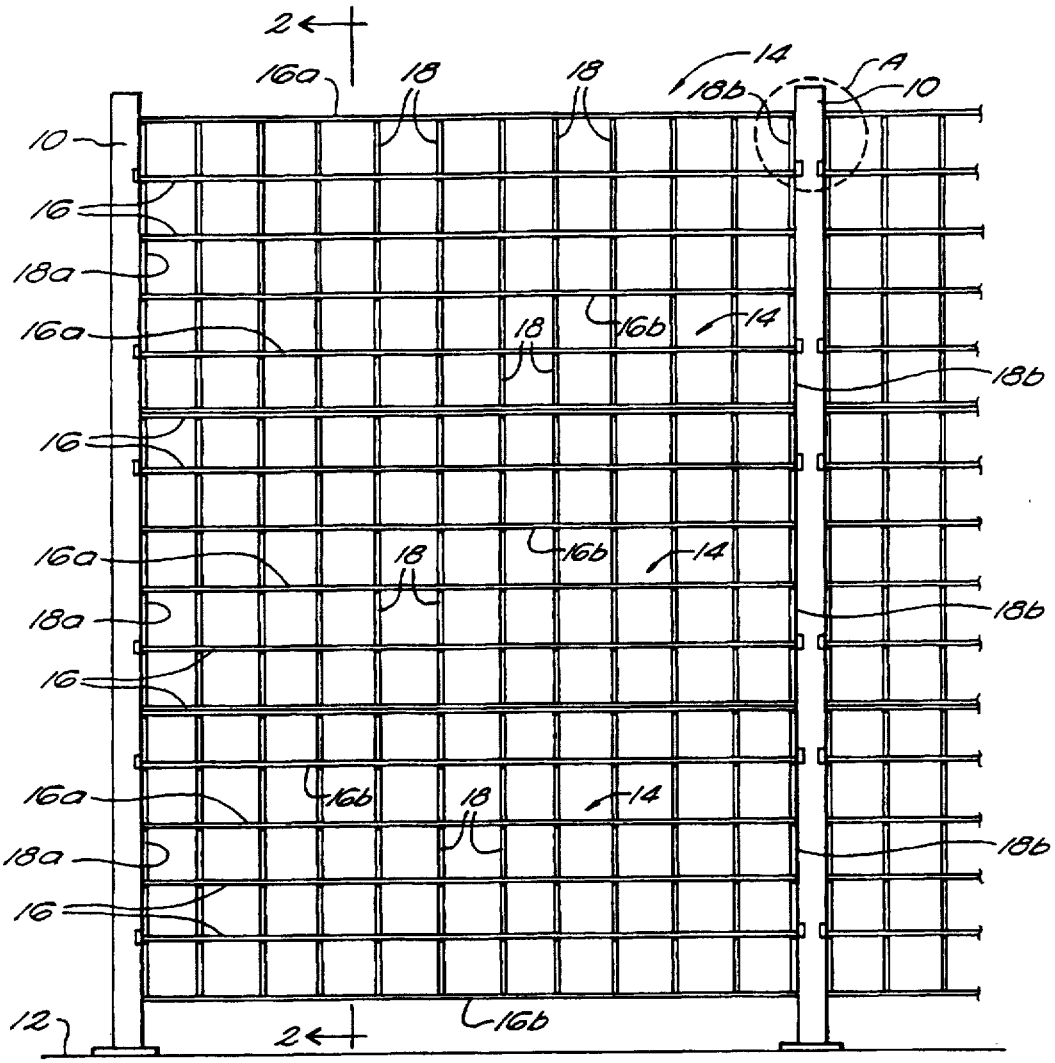
FIG. 1 is an exterior elevational view of a portion of a wall construction in accordance with an exemplary embodiment the present invention.
Figure 2:
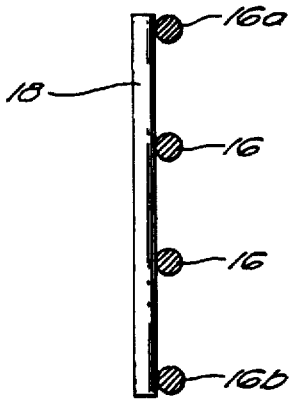
FIG. 2 is a sectional view taken along line 2—2 of FIG. 1.

Referring initially to FIGS. 1 and 2, an exemplary embodiment of a modular wall construction in accordance with the present invention is shown. The construction includes a plurality of laterally spaced vertically disposed support posts 10 fixed to the floor 12 by any convenient means, typically by anchor bolts or the like (not shown). A plurality of panels 14 are arranged vertically in a coplanar relationship between the support posts. The number of panels may vary widely, depending on the desired height of the partition. In the example provided, four panels are shown vertically arranged for illustrative purposes.

Each panel 14 has a rectangular configuration and comprises a frameless grid array of a plurality of horizontally arranged rods 16 which overlap a plurality of vertically arranged rods 18. The panel is bordered by an uppermost horizontal rod 16*a*, a lowermost horizontal rod 16*b*, a leftmost vertical rod 18*a* and a rightmost vertical rod 18*b*. The vertical and horizontal rods are connected to one another at overlapping portions in a conventional manner, e.g. spot welding. Preferably, an adjacent or underlying panel will be arranged such that the outermost rods of the panels will not be separated by a space larger than the spacing between the rods in each panel. For example, the rod 16*b* of the top panel shown is situated so as not to be separated from the rod 16*a* of the underlying panel by a space larger than the spacings between each rod 16 of the respective panels.

With reference now to FIGS. 3–5, each support post 10 preferably comprises a hollow box beam with a front (or rear) mounting surface 30 and with side surfaces 32 extending rearwardly from the mounting surface to a rear surface 34. Each front mounting surface 30 has a plurality of vertically spaced pairs of openings 36 provided at opposite edges of the mounting surface adjacent to the surfaces 32. Each opening has a top edge segment 36*a* and a bottom edge segment 36*b*. The openings 36 are preferably disposed adjacent the side surfaces 32 to provide support for accommodating hole punching of the tubular post without crushing the post. This process allows the walls of the posts to be relatively thinner than situations where the openings would be punched in an intermediate area of the mounting surface 30.

As can best be seen in the exemplary embodiment of FIG. 4, a horizontal rod 16 is configured to include a connector element 40. The connector element 40 includes a portion of a selected rod 16*c* that extends beyond the bordering vertical rod, for example 18*b*, and which is bent downwardly to form a hook 42. It will be appreciated that equivalent connector elements 40 are provided in each of the upper and lower, right and left side quadrants of each panel 14.

The method of assembling the wall construction is now described. A panel member 14 is positioned between the support posts 10, with the connecting elements 40 overlapping the front mounting surface 30, and with the hooks 42 located within the respective openings 36. The panel is then dropped relative to the support post, thereby allowing the hooks 42 to descend behind the bottom edge segments 36*b* of the openings 36 to establish a firmly interlocked relationship behind the mounting surface 30.

At this point, and with reference to FIG. 4, a fastener 50, such as a drive-pin fastener or tamper resistant screw, is inserted into selected slots 36 between the connector element 40 and the top edge segment 36*a*. Thus, the interaction between the fastener 50 with the slot edges and the interaction between the hook 42 with the bottom edge segment 36*b* and the inner part of the mounting surface 30 prevent the connector element 40 from being removed from the opening 36. It will be appreciated that only one fastener per side of a panel is necessary to adequately keep the panel and hooks in place. Accordingly, the panel 14 is securely connected to the support posts 10 in a secure manner without the need for welding.

Figure 6:
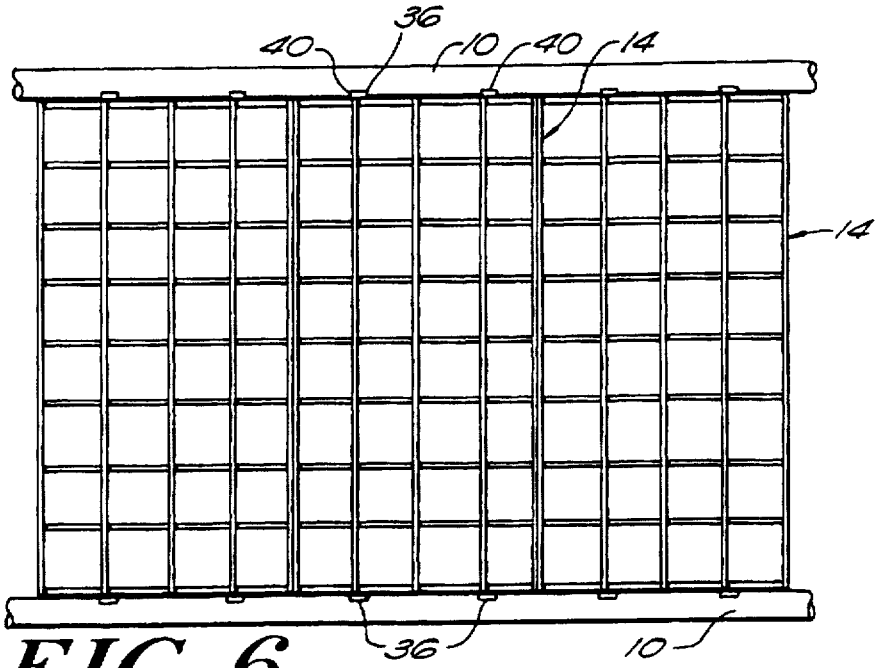
FIG. 6 is an exterior plan view of a portion of a wall construction in accordance with an alternative embodiment the present invention.

It will be appreciated by those of skill in the art that several modifications to the illustrated embodiment are possible. For example, the panels 14 and support posts 10 may be disposed in a horizontal manner to provide a top or roof portion for the modular wall construction. In addition, the openings 36 and connector elements 40 may be configured in a horizontal manner, rather than the illustrated vertical configuration, in both vertical and horizontal modular constructions, as shown in FIG. 6. The exemplary embodiment of FIG. 6 is preferably for ceiling configurations.

Figure 7:
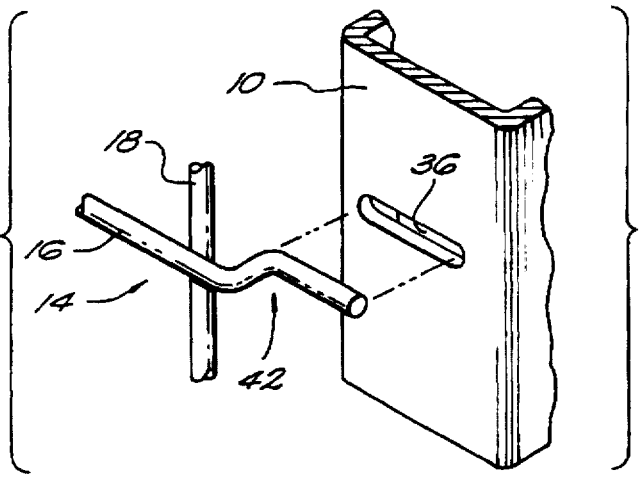
FIG. 7 is an enlarged perspective view of a connector element in an alternative embodiment of the present invention.
Figure 8:
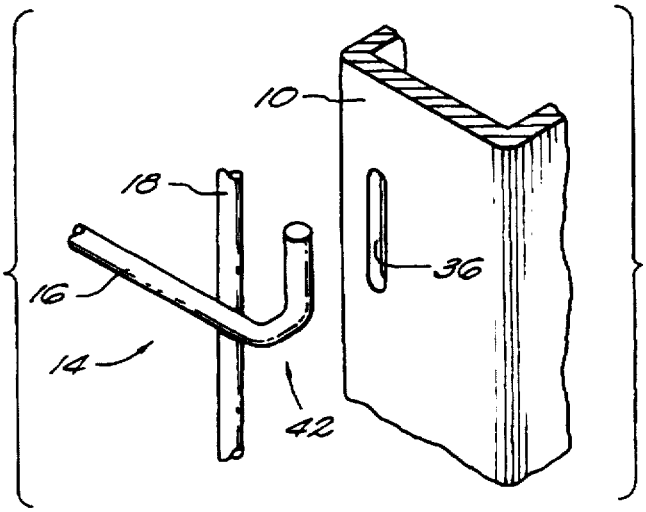
FIG. 8 is an enlarged perspective view of a connector element in another alternative embodiment of the present invention.
Figure 9:
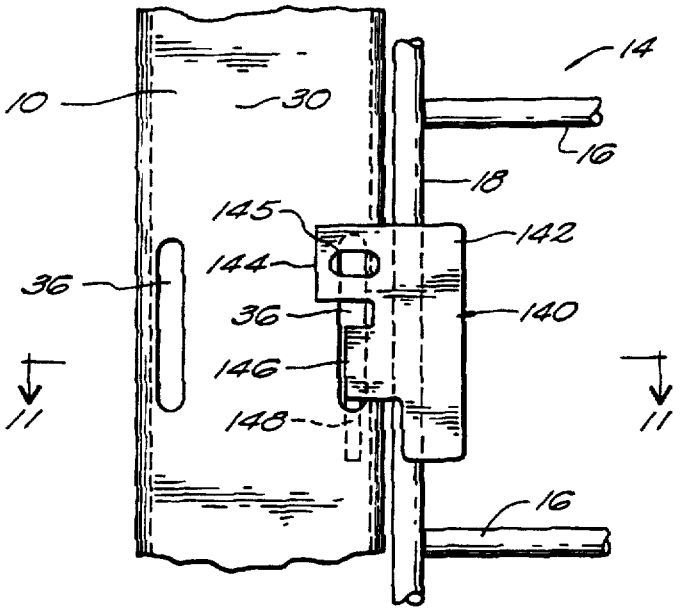
FIG. 9 is an enlarged frontal view of an alternative embodiment of the present invention.

FIG. 7 shows an alternative arrangement in which the hook 42 and opening 36 are configured perpendicularly with respect to the support post. FIG. 8 shows another alternative arrangement in which the hook 42 is bent in a relatively upward direction with respect to the arrangement shown in FIG. 4.

It will also be appreciated that the rods of the panels 14 need not necessarily be arranged in horizontal and vertical configurations. For example, the rods can be arranged in a diagonal configuration, while having selected rods to extend beyond a predefined border to be configured as a connecting element. Furthermore, the rods can be arranged in any desired manner to overlap one another to allow for connection between the rods to form a selected array other than the exemplary grid pattern. Also, the connecting elements can be configured with selected rods from either the horizontal or vertical rods in the illustrated embodiment.

With reference now to FIGS. 9–12, an alternative exemplary embodiment of the present invention is shown. A connector element 140 is adapted to be assembled onto one of the vertical rods 18 of the panel 14, which has a rectangular configuration and comprises a frameless grid array of a plurality of horizontally arranged rods 16 which overlap a plurality of vertically arranged rods 18 as previously described. The connector element 140 includes a face plate 142 and an integral first flange member 141 which forms a receiving region 143. The connector element is attached to the panel 14 by engaging a portion of a rod 18 into a friction fit setting within the receiving area 143. The face plate 142 has an integral second flange member 144 with a through hole 145. A third flange member 146 terminates in an integral perpendicular tab 148 which extends downwardly to form a hook. It will be appreciated that equivalent connector elements 140 are provided in each of the upper and lower, right and left side quadrants of the panel 14.

Figure 11:
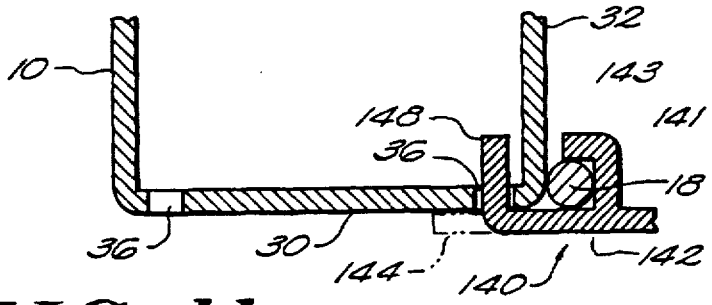
FIG. 11 is a horizontal sectional view taken along line 11—11 of FIG. 9.

The method of assembling the wall construction is now described. A panel member 14 is positioned between the support posts 10, with the flange members 144, 146 of connector element 140 overlapping the front mounting surface 30, and with the tab 148 located within the respective opening 36. The panel is then dropped relative to the support post, thereby allowing the tab 148 to descend behind the bottom edge segment 36*b* of the opening 36 to establish a firmly interlocked relationship behind the mounting surface 30. At the same time, the through hole 145 of the flange 144 becomes aligned with the top edge segment 36*a* of the opening. In this state, the side surface 32 is situated to prevent removal of the portion of rod 18 from the receiving region 143 of the connector element 140 as best seen in FIG. 11.

Figure 10:
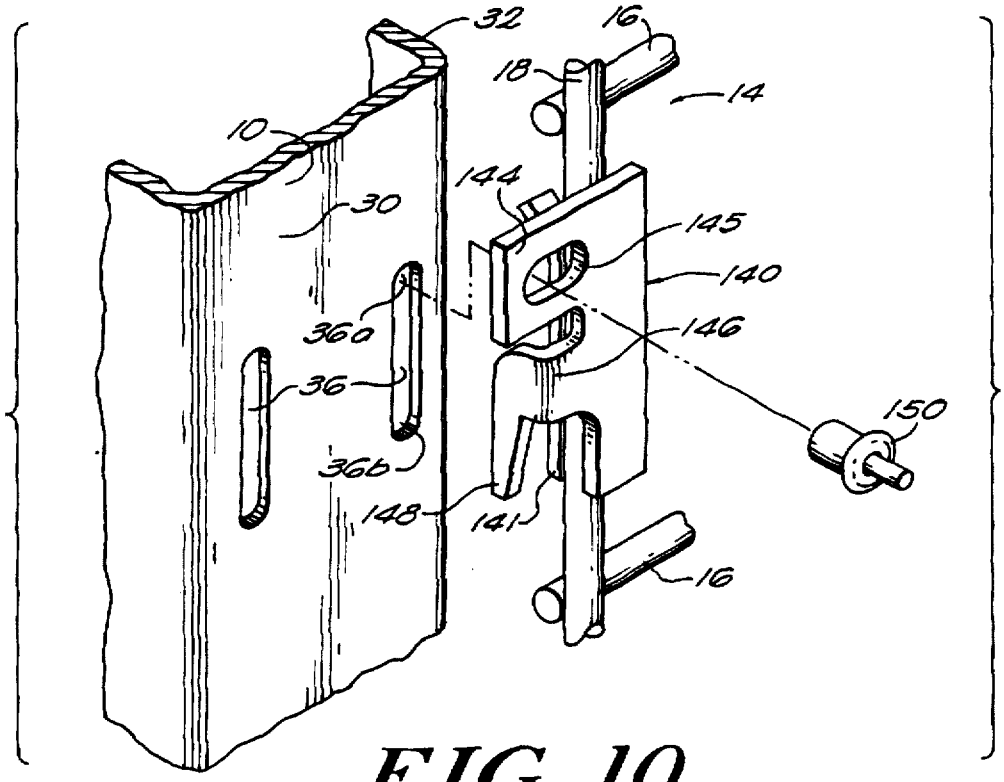
FIG. 10 is an enlarged perspective view of an alternative embodiment of a connector element of the present invention and a support post prior to assembly.

At this point, and with reference to FIG. 10, a fastener 150, such as a drive-pin fastener or tamper resistant screw, is inserted through the through hole 145 and becomes engaged with the top edge segment 36*a*. Thus, the interaction between the fastener 150 with the top edge segment 36*a* and the interaction between the tab 148 with the bottom edge segment 36*b* and the inner part of the mounting surface 30 prevent the connector element 40 from being removed from the opening 36. Accordingly, the panel 14 is securely connected to the support posts 10 in a secure manner without the need for welding.

Figure 12:
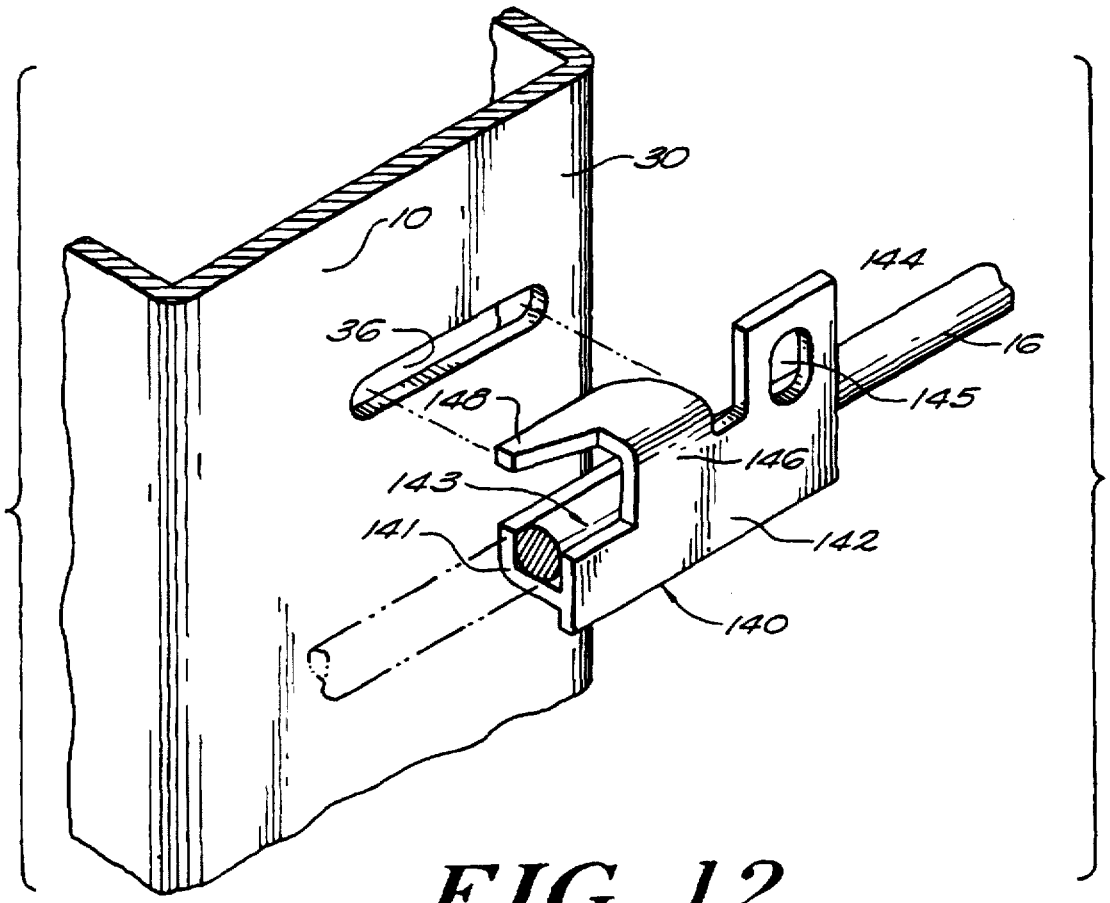
FIG. 12 is an enlarged partially cutaway perspective view of an alternative embodiment of a connector of the present invention and a support post prior to assembly.

It will be appreciated by those of skill in the art that several modifications to the illustrated alternative embodiment are possible. For example, the panels 14 and support posts 10 may be disposed in a horizontal manner to provide a top or roof portion for the modular wall construction. In addition, the openings 36 and connector elements 40 may be configured in a horizontal manner, rather than the illustrated vertical configuration, in both vertical and horizontal modular constructions. FIG. 12 shows an alternative arrangement in which the hook 142 and opening 36 are configured perpendicularly with respect to the support post. Another alternative arrangement is apparent in which the hook 142 is bent in a relatively upward direction with respect to the arrangement shown in FIG. 10.

The foregoing description has been set forth to illustrate the invention and is not intended to be limiting. Since further modifications of the described embodiments incorporating the spirit and substance of the invention may occur to persons skilled in the art, the scope of the invention should be limited solely with reference to the appended claims and equivalents thereof.

What is claimed is:

1. A modular wall construction comprising:

a plurality of laterally spaced support posts having mutually spaced slots in commonly facing walls thereof, each slot being at least partially defined by oppositely disposed first and second edge segments;

at least one panel arranged between said support posts;

connecting elements integrally formed with and extending laterally from said panel to overlie the commonly facing walls of said support posts at said slots, said connecting elements having hook shaped portions received in said slots in engagement with the first edge segments thereof; and at least one fastener which extends into a selected slot between a corresponding connecting element positioned within said selected slot and a second edge segment associated with said selected slot to coact in engagement with said selected slot and said corresponding connecting element to prevent disengagement of a hook of said corresponding connecting element from a first edge segment associated with said selected slot, wherein said panel comprises a coplanar array of interconnected rods, and wherein said connecting elements comprise portions of selected rods which are bent out of the plane of said array to define said hook shaped portions.

2. The modular wall construction of claim 1, wherein said support posts are tubular and have a rectangular cross sectional configuration, with side walls extending rearwardly from a front wall to a rear wall, said slots being located proximate to the junctures of said front and side walls.

3. The modular wall construction of claim 1, wherein said support posts and said panel are vertically arranged.

4. The modular wall construction of claim 1, wherein said support posts and said panel are horizontally arranged.

5. The modular wall construction of claim 1, wherein said slots extend vertically.

6. The modular wall construction of claim 1, wherein said slots extend horizontally.

7. The modular wall construction of claim 1, wherein said array of interconnected rods comprises a grid of rods having a plurality of vertically arranged rods overlying and connected to a plurality of horizontally arranged rods.

8. A modular wall construction comprising:

a plurality of laterally spaced support posts having mutually spaced slots in commonly facing walls thereof, each slot being at least partially defined by oppositely disposed first and second edge segments;

at least one panel arranged between said support posts;

connecting elements removably coupled to and extending laterally from said panel to overlie the commonly facing walls of said support posts at said slots, said connecting elements having hook shaped portions received in said slots in engagement with the first edge segments thereof, and having openings therein aligned with said slots adjacent to the second edge segments thereof; and fastening means extending through said openings into said slots to coact in engagement with said second edge segments to prevent disengagement of said hook portions from said first edge segments, wherein said panel comprises a coplanar array of interconnected rods, and wherein said connecting elements are configured to substantially surround to selected ones of said array of interconnected rods.

9. The modular wall construction of claim 8, wherein said support posts are tubular and have a rectangular cross sectional configuration, with side walls extending rearwardly from a front wall to a rear wall, said slots being located proximate to the junctures of said front and side walls.

10. The modular wall construction of claim 8, wherein said support posts and said panel are vertically arranged.

11. The modular wall construction of claim 8, wherein said support posts and said panel are horizontally arranged.

12. The modular wall construction of claim 8, wherein said slots extend vertically.

13. The modular wall construction of claim 8, wherein said slots extend horizontally.

14. The modular wall construction of claim 9, wherein said connecting elements include upper and lower flanges, said lower flanges being bent rearwardly to define said hook shaped portions, and said upper flanges being arranged to overlie said front walls and having said openings extending therethrough.

15. The modular wall construction of claim 14, wherein said openings and said hooked shaped portions are arranged in parallel with respect to said support posts.

16. The modular wall construction of claim 14, wherein said openings and said hooked shaped portions are arranged perpendicularly with respect to said support posts.

17. The modular wall construction of claim 8, wherein said fastening means comprise pin members which coact in engagement with the edges of said openings to resist subsequent removal thereof.

18. The modular wall construction of claim 9, wherein said connecting elements include coupling flanges being configured rearwardly to define receiving regions into which portions of said panel are received for coupling said connector elements to said panel.

19. The modular wall construction of claim 18, wherein said coupling flanges are arranged to overlie said side walls so as to prevent removal of said portions of said panel received within said receiving region when said connecting elements are engaged with said support posts.

* * * * *